US007549764B2

(12) United States Patent
Ko

(10) Patent No.: US 7,549,764 B2
(45) Date of Patent: Jun. 23, 2009

(54) SOLAR POWERED MAILBOX LIGHT WITH MOVABLE MAGNETIC CONNECTION

(76) Inventor: Gordon Ko, 10 Pala Mesa Dr., Phillips Ranch, CA (US) 91766

( * ) Notice: Subject to any disclaimer, the term of this patent is extended or adjusted under 35 U.S.C. 154(b) by 81 days.

(21) Appl. No.: 11/800,252

(22) Filed: May 4, 2007

(65) Prior Publication Data

US 2008/0273320 A1 Nov. 6, 2008

(51) Int. Cl.
*F21L 4/00* (2006.01)
*F21L 13/00* (2006.01)

(52) U.S. Cl. ..... 362/183; 362/276; 362/285; 362/372; 362/802

(58) Field of Classification Search ..... 362/183, 362/276, 285, 372, 802; 232/17, 29, 38, 232/45; 40/606.06
See application file for complete search history.

(56) References Cited

U.S. PATENT DOCUMENTS 7,178,715 B1 2/2007 Dean

*Primary Examiner*—Sandra L O'Shea
*Assistant Examiner*—Jason Moon Han

(57) ABSTRACT

The present invention is a solar powered light assembly mounted at a distal end of a flexible neck support, where a proximal end is fixed to a top of an exterior panel housing of an exterior panel that supports the neck support and light in a position which can be easily manipulated by a user. Presented at an underside of the exterior panel is a first flat magnet generally co-extensive with the entire underside of the exterior panel. An interior panel comprises a second flat magnet with approximately the peripheral shape as that of the first flat magnet. A secure fixation of the exterior panel on an outside surface of a mailbox, regardless of the location on said outside surface, can be achieved by the invention assembly by placing an upper surface of the interior panel adjacent to a portion of the relatively thin wall of the mailbox where the underside of the exterior panel has been located. The magnetic attraction of the first and second flat magnets causes the exterior panel to remain fixed at an outside surface of the mailbox at a desired location.

4 Claims, 4 Drawing Sheets

SOLAR POWERED MAILBOX LIGHT WITH MOVABLE MAGNETIC CONNECTION

FIELD OF THE INVENTION

The present invention relates to illumination devices for fixed, outdoor enclosures having access via a vertical door such as a mailbox, more particularly where a top wall or sidewall of the enclosure comprises a relatively thin and rigid thickness.

BACKGROUND OF THE INVENTION

Outdoor mailboxes for receiving mail from a postal service are known to be used in both rural and suburban areas. A typical mailbox is one which is fixed upon a vertical support such as a post (in the case of a single mailbox) or upon a frame (in the case of multiple mailboxes.

The outdoor location of mailboxes is determined by the postal service delivering mail to a residence or business. The locations of stand-alone mailboxes are generally near a roadway so that postal service personnel can easily drive their vehicle to a place near a roadway-directed access door, open the access door from their vehicle, deposit mail inside the mailbox, and then close the access door. It is rare that location of the roadside residence mailbox is near electrical utilities.

It is well known that retrieving mail from such a mailbox under dimmed light or nighttime conditions is inconvenient or difficult. The location of the mailbox is typically far from outdoor lighting sources and outdoor dim light conditions means that an interior of the mailbox will be much darker.

The prior art has suggested that a solution to dim light or nighttime conditions would be to provide some type of light inside the mailbox itself. Such a solution is described in U.S. Pat. No. 7,178,715, where a light source is fixed on a rotatable arm so that it can be moved into an illuminating position of an interior space of a mailbox. The device described in this patent requires a somewhat complicated installation and extensive retrofit as to an existing mailbox. The device of the '715 patent in practice requires the purchase of an entire mailbox assembly to obtain the benefits the lighting device. The expected serviceable life of a mailbox is many years which is a disincentive to someone desiring the benefits of the device of the '715 patent without being required to invest in an entirely new mailbox.

It is well known that mailboxes have been formed of weather resistant plastics or aluminum, where magnetic attachment of external devices is impossible. The solar powered and internally lighted house number box of U.S. Pat. No. 6,299,325 is preferably attached to a topmost semi-cylindrical surface at the top ridge of a mailbox by adhesives. The connection to said top ridge of the mailbox can be accomplished by way of screw connection. These means for fixing the number box to a mail box can leave holes in the box or unsightly adhesive residue if a user wishes to remove the number box or relocate it to another outside surface area of the mailbox. It is well known to provide a solar panel at an outside surface of a lighted house number box so that electrical power is stored in a re-chargeable battery within the box.

There is a need for a lighting device for a standalone mailbox that in capable of illuminating an inside space of a mailbox that eliminates the need for connection to a power supply from an established grid while being capable of being attached securely and easily to the mailbox itself regardless of the composition of the mailbox.

SUMMARY OF THE INVENTION

The present invention is a solar powered light assembly mounted at distal end of a flexible neck support, where a proximal end is fixed to a top of an exterior panel housing of an exterior panel that supports the neck support and light in a position which can be easily manipulated by a user. Presented at an underside of the exterior panel is a first flat magnet generally co-extensive with the entire underside of the exterior panel. An interior panel comprises a second flat magnet with approximately the peripheral shape as that of the first flat magnet. A secure fixation of the exterior panel on an outside surface of a mailbox, regardless of the location on said outside surface, can be achieved by the invention assembly by placing an upper surface of the interior panel adjacent to a portion of the relatively thin wall of the mailbox where the underside of the exterior panel has been located. The magnetic attraction of the first and second flat magnets causes the exterior panel to remain fixed at an outside surface of the mailbox at a desired location. The addition of the second flat magnet of the interior panel to assist in securing the exterior panel to the exterior of the mailbox eliminates the need to provide a concave attachment for the underside of the exterior panel. This problem was clearly seen in the provision of a semi-cylindrical underside of the house numbers box of the '325 patent to adapt the box to the typical rounded top surface of a standalone mailbox.

The invention light assembly comprises a solar cell array electrically connected to a re-chargeable battery or set of batteries. The battery or batteries is electrically connected to the light mounted at the distal end of the flexible neck support. The light assembly uses a power charging mode during generally daylight hours to charge the battery with energy generated and provided by the solar cell array, and a photo switching device to switch from the power charging mode to a power source mode during generally non-daylight hours to enable the battery array to discharge current to the illuminated module to light up the light in the illuminated module with a light source mounted in each housing. The discharge mode can also be activated by movement of an on-off switch to an "on" position. One or more light bulbs or light emitting diodes are lighted during the discharge mode, whereafter a user can grasp the middle section or distal end of the flexible neck support and direct the light from the light bulbs or LED's into an interior space of the mailbox.

In a terminal end embodiment of the invention, a terminal housing fixed at the distal end of the flexible support neck contains support for the solar cell array and an internal cavity for protection of electrical components of the power storage and switching means such as the batteries and electrical circuits and relays. The terminal housing is adapted to provide somewhat of a reflective surface and protection for the lighting elements such as light bulbs or LED's. In this embodiment, all the electrical components of the light assembly are provided in or supported from a single housing held aloft by the support of the flexible neck support. Therefore, the exterior panel consists only of connection means for the proximal end of the flexible neck support and the first flat magnet. The manufacturing steps for the exterior panel are quite simple as compared with similar mounting means described in the prior art. In this embodiment, the terminal housing may comprise means for threadedly connecting and disconnecting the terminal housing from the distal end of the flexible neck. A user may then change the type of light to a brighter set of lighting elements in another replacement terminal housing or other such change. In addition, a lighting element may be replaced with a higher or lower intensity device by way of a socket located in the terminal housing.

In an exterior panel embodiment of the invention, the lighting element or elements are fixed to the distal end of the flexible neck support while electrically connective wiring is routed through a bore in the neck support from the lighting element to the interior of the exterior panel housing. A top surface of the exterior panel housing bears the solar cell arrays which are electrically connected with switching and connection circuits within the exterior panel housing. The switching and connection circuits within the exterior panel housing are in turn electrically connected with the wiring from the lighting element so that the lighting element can be turned on.

DETAILED DESCRIPTION OF THE INVENTION

The invention is now discussed with reference to the figures.

Figure 1:
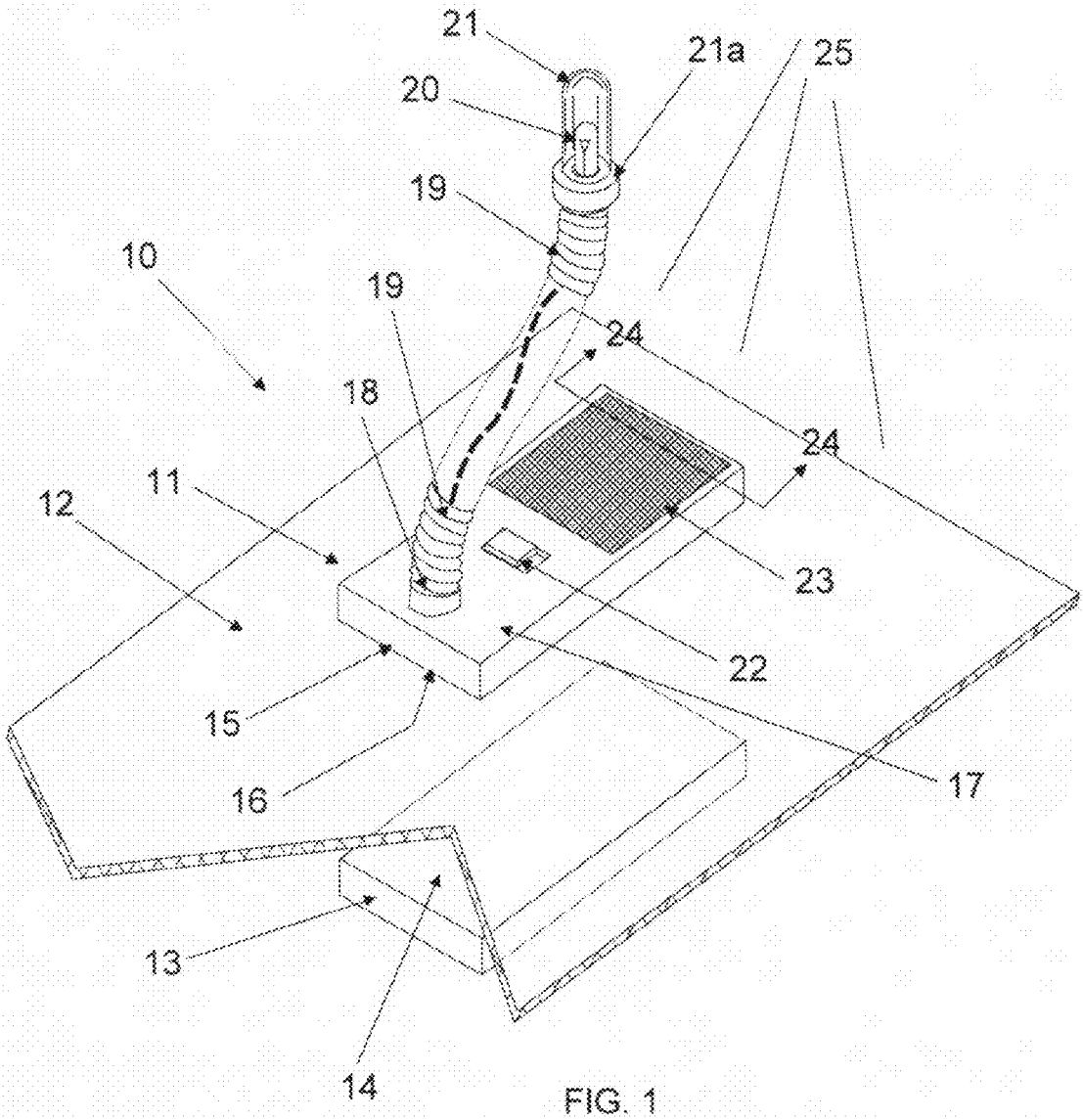
FIG. 1 is top perspective view of an exterior panel embodiment of the invention light assembly showing a lighting element, a flexible neck support, an exterior panel, an interior panel and a thin support wall intervening between the magnetically oriented surfaces of the exterior panel and the interior panel.

FIG. 1 shows an invention light assembly 10 comprising an outside portion which further comprises an exterior panel 11 supporting a flexible neck support 19, which further supports a lighting element. A housing for the exterior panel 11 comprises a top surface 17, side walls 15, and a bottom surface 16. Top surface 17 supports a solar cell array 23 and mount 18 at a proximal end of flexible neck support 19. Mount 18 rigidly fixes the proximal end of flexible neck 19 to top surface 17 so that flexible neck support 19 is supported above top surface 17. Solar rays 25 are shown illuminating solar cell array 23, which absorbed energy is stored in re-chargeable battery(ies) within a storage cavity within the housing of exterior housing 11.

Light assembly 10 further comprises an interior panel 13 which is preferably about the same size and shape as the housing of the exterior panel 11, where interior panel 13 comprises a flat magnetic surface 14 intended to be directed to align with bottom surface 16 of exterior panel 11. Thin wall 12 is a flat or curved wall comprised of magnetic or non-magnetic material with an outdoor exposed surface on the side where the outside portion of light assembly 10 is shown, where the exposed surface is provided exposure to direct sunlight for some portion of the day. While it is preferable that thin wall 12 comprise a portion of a standalone mailbox, thin wall 12 may also be a window of a house, office or vehicle or a cabinet or locker door or side wall. These locations sometimes are benefited by location of a solar powered lighting element as described herein magnetically mounted upon the thin wall. The thin wall 12 may be vertical, horizontal, or inclined. The invention light assembly 10 is adaptable for placement in many locations.

Top surface is provided with an on-off switch 22. Switch 22 is moveable from side to side so that lighting element 20 may be turned on or off. It is more preferred that switch 22 comprise one which activated by downward pressure of a user's finger and is sealed against infiltration of water or dust into the cavity within the housing cavity. It is also more preferred that switch 22 be located on a side wall of said housing oriented substantially vertical when fixed to a mailbox so that water would not tend to accumulate upon the structure of switch 22. A bulb shown as lighting element 20 is secured in a socket fixed to a distal end of flexible support neck 19. A protective cover 21 is adapted to shield a user's eyes from illumination from lighting element 20 and to protect lighting element 20 from breakage and weather. Flexible support neck 19 comprises a tube segmented or other flexible means which allow a user to change shape of neck 19 in the manner of a goose neck lamp so that the shape of the neck 19 remains in place after change by a user. It is intended that a user will desire to move the location of lighting element 20 to multiple orientations and directions after a user has installed the light assembly 10 on a thin wall 12.

Light assembly 10's solar cell array 23 is electrically connected to a re-chargeable battery or set of batteries contained within the storage cavity of the housing of exterior panel 11. The battery is electrically connected by wires comprising control and switching circuits which pass through a bore in neck 19 to the lighting element 20 mounted at the distal end 21a. The light assembly 10 uses a power charging mode during generally daylight hours to charge the battery with energy generated and provided by the solar cell array 23, and a photo switching device to switch from the power charging mode to a power source mode during generally non-daylight hours to enable the battery to discharge current to the illuminated module to light up the lighting element 20 in the illuminated module with a light source mounted in each housing. The discharge mode can also be activated by movement of an on-off switch to an "on" position.

Figure 2:
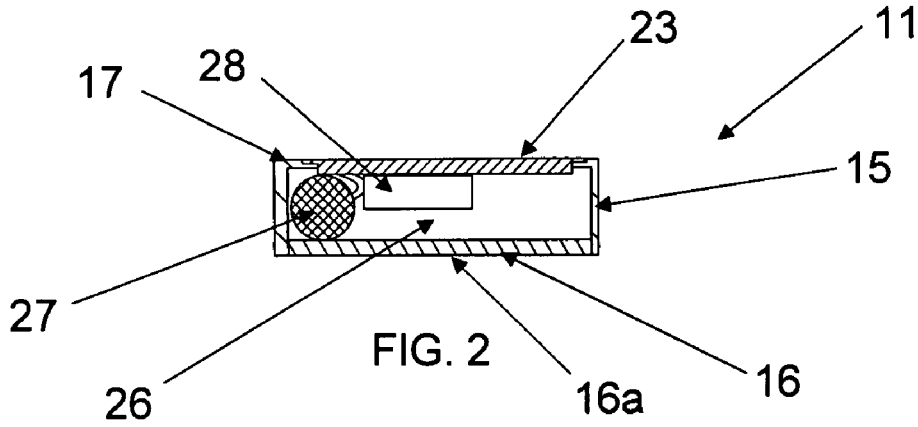
FIG. 2 is section 24 of the exterior panel of FIG. 1.

FIG. 2 is section 24 of the exterior panel of FIG. 1, showing a cross section of the housing of the exterior panel 11 and the storage cavity 26 therein. Cavity 26 provides room for location of battery 27 and switching and control circuits 28. Battery 27, control circuits 28, solar cell array 23 and lighting element 20 (FIG. 1) are all connected by electrical wire connections to obtain the objects of the invention. Circuits 28 preferably comprise light sensors (exposed to the exterior of panel 11), switches, circuits, and logic means for effecting charging, rest and discharge modes of the invention. Battery 27 is charged in a charging mode by solar radiation received at array 23 when element 20 is not activated. The charging mode may be initiated by detection of the light sensor that it is daytime or upon detection that the on-off switch has been turned off. Alternately, it is well known that a charging mode of a solar cell array may be started when electrical output above a low threshold is detected from the solar cells, thereby indicating that it is daytime. A discharge mode is preferably initiated by detection that radiant light (i.e., sunlight) striking the solar cell array is insufficient for minimum required generation of electrical power. It is common and well known that light or photo sensors may cause activation of the lighting element upon detection of a nearby light that is incapable of causing the solar cell array to generate electrical power. Such circumstances may occur at nighttime and prevents the lighting element to be turned on. In the discharge mode, power is drawn from the battery to cause element 20 to be illuminated.

Panel 11 also comprises, as shown in FIG. 2, a large flat permanent magnet 16a coextensive with bottom surface 16 and magnetized with polarity up and down from the cross section shown therefor. A similar flat permanent magnet comprises the upper surface 14 of interior panel 13 (FIG. 1).

Figure 3:
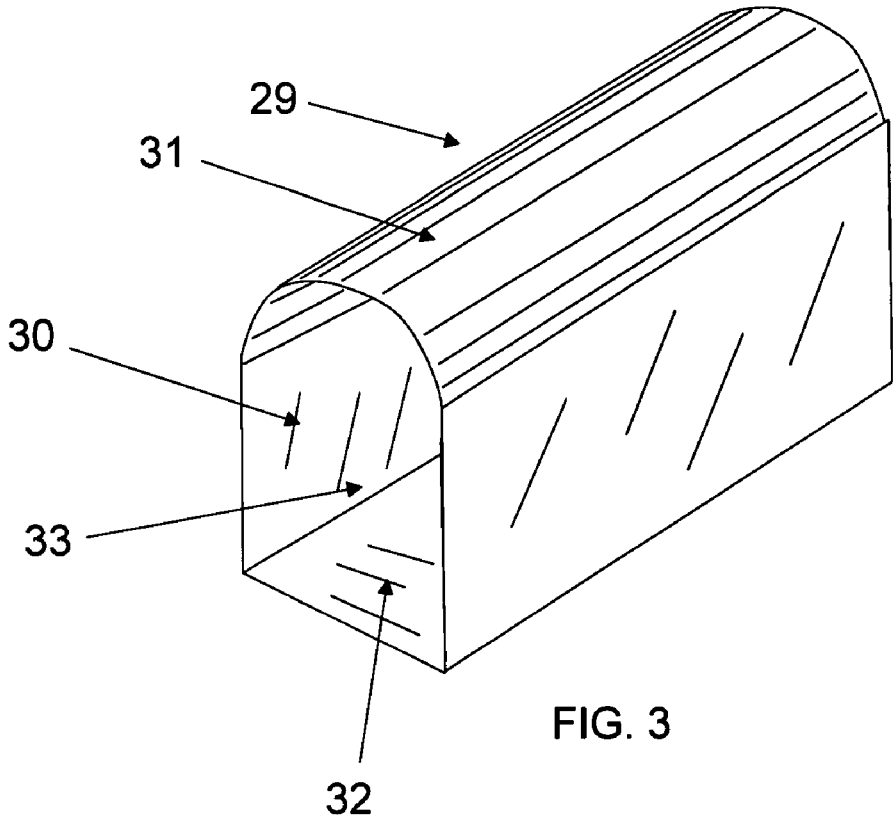
FIG. 3 is top perspective view of a typical standalone mailbox (without typical post or frame support from ground level).

FIG. 3 is top perspective view of a typical standalone mailbox 29 (without typical post or frame support from ground level) comprising a floor 32 for support of mail, side panels 30 and a top arched upper section 31, all of which define an internal space 33 which shall be illuminated by the invention light assembly.

Figure 4:
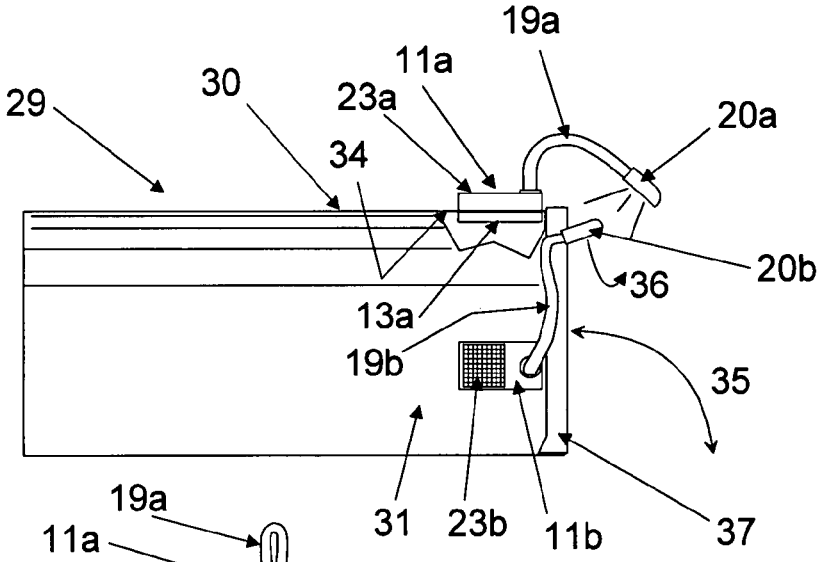
FIG. 4 is the invention light assembly of FIG. 1 on a top ridge and a side panel of the mailbox of FIG. 3, which is shown in side view.

FIG. 4 shows two invention light assemblies of FIG. 1 releaseably fixed to the mailbox of FIG. 3. A first light assembly comprises an exterior panel 11*a*, a solar cell array 23*a*, flexible neck support 19*a* and lighting element 20*a* on an exterior top ridge of upper section 31, which is broken away to show interior panel 13*a* on a top ridge and a side panel of the mailbox of FIG. 3, which is shown in side view. Lighting element 20*a* is capable of illuminating a front of mailbox door 37 as well as an internal space when door 37 is opened. In addition, a user may grasp lighting element 20*a* and cause flexible neck support 19*a* to be deformed so that lighting element 20*a* is caused to illuminate in another direction. A second light assembly comprises an exterior panel 11*b*, a solar cell array 23*b*, flexible neck support 19*b* and lighting element 20*b* releaseably fixed on side panel 31. Lighting element 20*b* is capable of illuminating a front of mailbox door 37 but is preferably moved into an illuminating position of the internal space of mailbox 29 when 37 is opened.

Figure 5:
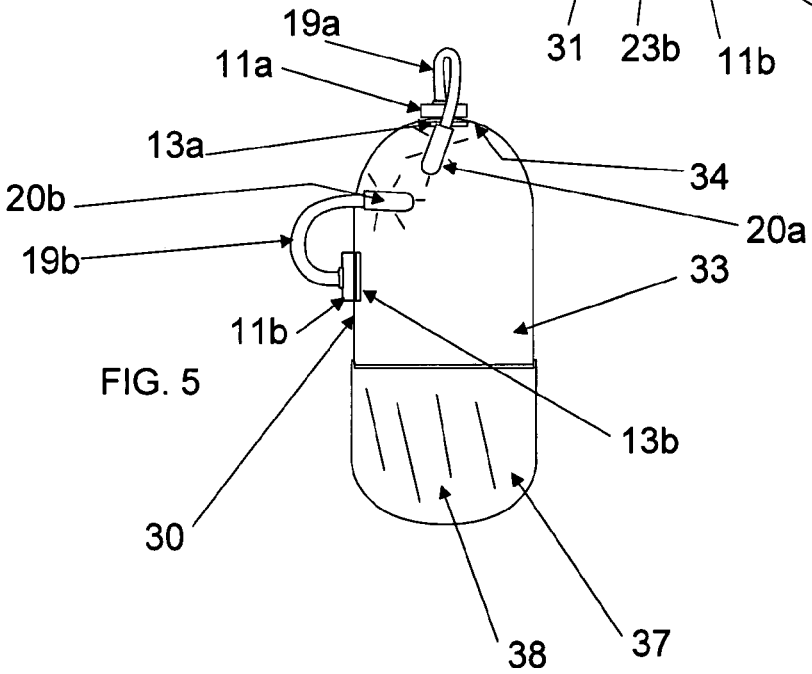
FIG. 5 is a front view of the mailbox and two invention light assemblies of FIG. 4 shown with flexible neck supports after having been moved by user's into a position where light elements of the light assemblies illuminate interior space of the mailbox.

FIG. 5 is a front view of the mailbox 29 with door 37 opened. The two invention light assemblies of FIG. 4 are shown with flexible neck supports 19*a* and 19*b* having been moved by user's into a position where light elements 20*a* and 20*b* illuminate interior space 33 of the mailbox 29. Flexible neck supports 19*a* and 19*b* are moved out of the way of door 37 when it is to be closed.

Figure 6:
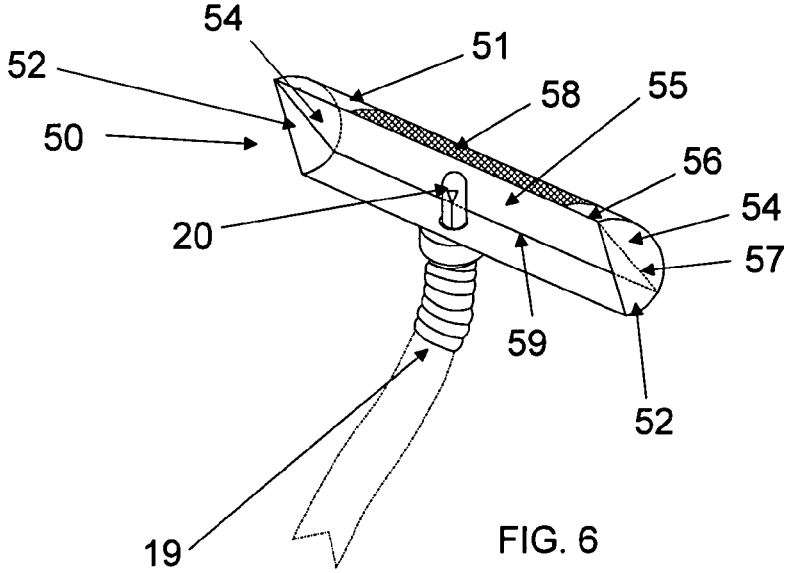
FIG. 6 is a partial view of the terminal housing embodiment of the invention showing only a part of the flexible neck support and a bottom perspective view of the terminal housing, solar cell arrays on the outside of the terminal housing, and a lighting element mounted in a protected position to the terminal housing.

FIG. 6 shows a terminal housing embodiment of the invention light assembly. FIG. 6 shows only the flexible neck support 19 and a bottom perspective view of the terminal housing 50. It is understood that a proximal end of flexible neck support 19 is rigidly connected to an exterior panel as described below. Such an exterior panel is adapted to be magnetically attached to a thin wall by placement of an appropriate interior panel opposite an underside of the exterior panel with the thin wall intervening therebetween. Housing 50 is intended to support and, as required or preferred for protection from the elements, enclose the electrically operative elements of the exterior panel 11 of FIG. 1, thereby eliminating the need for cavity 26 of FIG. 2 and reducing the height of an exterior panel to about only the thickness of magnet 16*a* of FIG. 2. Housing 50, in a preferred embodiment, is a concave, longitudinal shell 51 with ends 52 defining a concave space, a storage portion of which is enclosed by rectangular plate 55 sealed at edges 56/59 and 57 respectively to insides surfaces of shell 51 and ends 52. A solar cell array 58 is secured to an outside surface of shell 51, which is electrically connected with switch and control circuits and a rechargeable battery enclosed in the storage portion, which in turn is electrically connected with lighting element 20.

Figure 7:
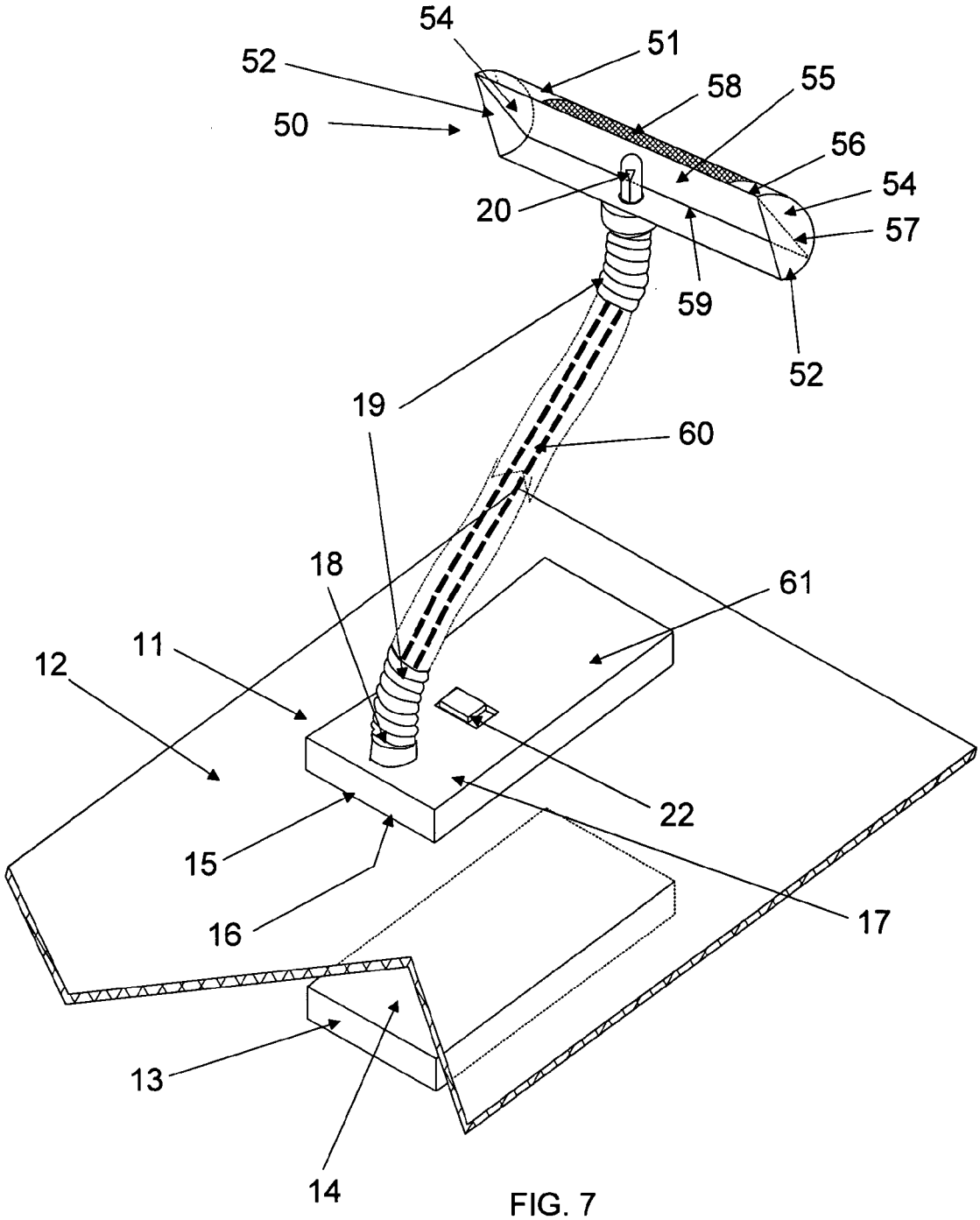
FIG. 7 is an alternate embodiment of the invention incorporating elements of the devices of FIG. 1 and FIG. 6.

FIG. 7 shows another form of the invention incorporating features of the devices shown and described in FIGS. 1 and 6, where switch 22 is presented for on-off control of control circuits and a rechargeable battery contained within housing 61. Two pairs of wires 60 extend from the control circuits and the rechargeable battery through the internal bore of flexible neck support 19 to connect with lighting element 20 and solar cell array 58. Securing the control circuits and a rechargeable battery within housing 61 moves substantial weight from terminal housing 50 as compared with the embodiment shown in FIG. 6 to a position closer to the support connection to the thin wall. The embodiment of FIG. 7 is less likely to become dislodged by wind forces as compared with the device shown in FIG. 6.

In a specific embodiment, a thin support wall for the invention light will have a thickness of from about 1 millimeter to about 4 millimeters. In addition, it is intended in another specific example that sufficient rechargeable batteries and electrical generating capacity of the solar cell array are provided so that the lighting element provides illumination in the discharge mode for a period of six hours or more, which time is typical of a user arriving home after the sun has gone down and would wish to get and examine their mail.

Among the functions of the invention lighting assembly are illumination of text or numbers on the outside of the mailbox in nighttime conditions, as well as illumination of the ground surrounding the mailbox. A user taking advantage of a flexible neck support of the lighting assembly may direct its illumination temporarily in many directions. A user may use the direction and/or color of the lighting element as an indicator to another person passing by the mailbox, i.e., a person looking for the home of the user may be told to look for a lighting element directed from a mailbox toward the other person's direction of approach to the mailbox location. Alternately, a colored lighting element may more easily identify a desired location to a passing vehicle or person who has been alerted that such a colored lighting element will indicate the desired destination.

The plate magnets on a lower housing and for its engaging magnet inside a mailbox may be one or more adjacent magnets fixed securely in a plastic body.

The above design options will sometimes present the skilled designer with considerable and wide ranges from which to choose appropriate apparatus and method modifications for the above examples. However, the objects of the present invention will still be obtained by that skilled designer applying such design options in an appropriate manner.

I claim:

1. A solar powered light assembly for outdoors with means for magnetically and releaseably clamping to a relatively thin wall comprising:

(a) an exterior panel with a top surface, a bottom surface and sidewalls joining them, thereby defining a storage cavity within;

(b) a solar cell array secured to the top surface and electrically connected with re-chargeable batteries, which in turn is connected to switching and control means for charging the battery when the solar cell array is exposed to the sun and for discharging the battery when the solar cell array is hidden from the sun; where the switching and control means and batteries are contained in the storage cavity;

(c) a flexible neck support supportively connected at a distal end to the top surface and supportively connected to a lighting element at a proximal end, where the flexible neck support is adapted to be arcuately deformed by a user whereby the flexible neck support will remain in the deformed position until deformed again by a user;

(d) wiring means for connecting the battery and switching and control means to the lighting element;

(e) a first flat plate magnet outwardly exposed from the bottom surface; and (f) an interior panel comprising a second flat plate magnet adapted to magnetically fix to the thin wall and the exterior panel when a flat side of the second flat plate magnet and an underside of the first flat plate magnet are applied to opposite sides of the thin wall.

2. The light assembly of claim 1 wherein the thin wall is a portion of side panels or a top section of a standalone mailbox.

3. The light assembly of claim 2 wherein the thin wall is a portion of the top section of the standalone mailbox near to an end of the mailbox having a hinged door with hinges at a floor level of the mailbox.

4. A solar powered light assembly for outdoors with means for magnetically and releaseably clamping to a relatively thin wall comprising:

(a) a lower housing comprising an exterior panel with a top surface, a bottom surface and sidewalls joining them, thereby defining a storage cavity within enclosing control circuits and one or more rechargeable batteries, and whereby an on-off switch is supportively presented on the lower housing;

(b) an upper housing defining a protective concavity for a lighting element, which lighting element is secured to the upper housing, and the upper housing supports a solar cell array on an outside surface of the upper housing outside of an inside surface defining said concavity;

(c) a flexible neck support supportively connected at a distal end to the top surface and extending up from the top surface to a proximal end which is supportively connected to the upper housing, where the flexible neck support defines an internal bore enclosing wires adapted to operatively connect the lighting element and solar cell array supported on the upper housing with the on-off switch, control circuits and batteries of the lower housing and moving the on-off switch to an on position engages means for charging the batteries by input from the solar cell array and for powering the lighting element by discharge of the batteries;

(d) a first flat plate magnet outwardly exposed from the bottom surface; and (e) an interior panel comprising a second flat plate magnet adapted to magnetically fix to the thin wall and the exterior panel when a flat side of the second flat plate magnet and an underside of the first flat plate magnet are applied to opposite sides of the thin wall.

* * * * *